US005720061A

United States Patent [19]

Giori et al.

[11] Patent Number: 5,720,061

[45] Date of Patent: Feb. 24, 1998

[54] FEMALE ANATOMICAL MATTRESS

[76] Inventors: Janine Giori; Gualtiero G. Giori, both of 1450 SW. 58th Ter., Cape Coral, Fla. 33914

[21] Appl. No.: 787,045

[22] Filed: Jan. 28, 1997

[51] Int. Cl.[6] ..... A47C 27/14; A47C 27/10

[52] U.S. Cl. ..... 5/735; 5/706; 5/710; 5/722; 5/733

[58] Field of Search ..... 5/735, 722, 731, 5/733, 737, 740, 930, 706, 710

[56] References Cited

U.S. PATENT DOCUMENTS

| | | | |
|---|---|---|---|
| 1,548,728 | 8/1925 | Milam | 5/735 |
| 2,462,579 | 2/1949 | Warner | 5/722 |
| 2,545,311 | 3/1951 | Rosberger | 5/722 |
| 2,830,306 | 4/1958 | Wagner et al. | 5/740 |
| 3,722,012 | 3/1973 | Tobinick et al. | 5/733 |
| 4,662,851 | 5/1987 | Foster | 5/722 |
| 4,748,768 | 6/1988 | Jacobsen | 5/740 |
| 4,815,287 | 3/1989 | Haluerson | 5/735 |
| 5,081,728 | 1/1992 | Skinner | 5/737 |
| 5,369,824 | 12/1994 | Powell | 5/735 |
| 5,400,449 | 3/1995 | Satto | 5/735 |

FOREIGN PATENT DOCUMENTS

| | | | |
|---|---|---|---|
| 2922443 | 12/1980 | Germany | 5/735 |

*Primary Examiner*—Alexander Grosz

[57] ABSTRACT

A female anatomical mattress including a generally rectangular body supporting structure. The body supporting structure has a pair of side walls with a continuous central section. The central section has an upper panel and a lower panel. The upper panel and lower panel each share a rounded front end and a rounded rear end. The upper panel has a generally rectangular cavity that extends downwardly therefrom and toward the lower panel. Lastly, a generally rectangular head supporting structure is rounded. The head supporting structure is sized for positioning within the cavity of the body supporting structure, when not supporting a person's head. The mattress may be foam filled or inflatable.

2 Claims, 3 Drawing Sheets

FEMALE ANATOMICAL MATTRESS

BACKGROUND OF THE INVENTION

1. Field of the Invention

The present invention relates to a female anatomical mattress and more particularly pertains to providing a mattress that will allow a woman to lie face down with the stomach resting against the mattress and the breasts resting within the cavity of the mattress.

2. Description of the Prior Art

The use of a female body support is known in the prior art. More specifically, female body supports heretofore devised and utilized for the purpose of allowing a woman to lay on her stomach are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,400,449 to Satto discloses a prone pregnancy cushion. U.S. Pat. No. 5,412,824 to Emerson et al. discloses an expandable support mattress, particularly to support woman during pregnancy. U.S. Pat. No. Des. 348,792 to Degroot discloses a segmented inflated mattress unit for use a body support. U.S. Pat. No. 4,054,960 to Pettit et al. discloses an inflatable body support cushion, particularly to support a woman during pregnancy. Lastly, U.S. Pat. No. 5,054,142 to Owens discloses a contoured body cushion.

While these devices fulfill their respective, particular objectives and requirements, the aforementioned patents do not describe a female anatomical mattress that allows a woman to lie on her stomach comfortably while allowing her breasts to rest within the cavity thus reducing breast compression the back strain that normally occurs when lying in this position.

In this respect, the female anatomical mattress according to the present invention substantially departs from the conventional concepts and designs of the prior art, and in doing so provides an apparatus primarily developed for the purpose of providing a mattress that will allow a woman to lie face down with the stomach resting against the mattress and the breasts resting within the cavity of the mattress.

Therefore, it can be appreciated that there exists a continuing need for a new and improved female anatomical mattress which can be used for providing a mattress that will allow a woman to lie face down with the stomach resting against the mattress and the breasts resting within the cavity of the mattress. In this regard, the present invention substantially fulfills this need.

SUMMARY OF THE INVENTION

In view of the foregoing disadvantages inherent in the known types of female body supports now present in the prior art, the present invention provides an improved female anatomical mattress. As such, the general purpose of the present invention, which will be described subsequently in greater detail, is to provide a new and improved female anatomical mattress and method which has all the advantages of the prior art and none of the disadvantages.

To attain this, the present invention essentially comprises a generally rectangular body supporting structure that is formed by three interconnected sectionals. The three interconnected sectionals are formed of a foam material. The three interconnected sectionals form a front section, rear section and a central section therebetween. The front section and the central section have one common fold. The rear section and the central section have another common fold. Each interconnected sectional has a pair of side walls with the side walls of each being continuous at the respective common fold of the three interconnected sectionals. Each of the three interconnected sectionals have an upper panel and a lower panel. The upper panel of the front sectional has a rounded front end that is shared with the Sower panel of the front sectional. The upper panel of the rear sectional has a rounded rear end that is shared with the lower panel of the fear sectional. The upper panel of the front sectional has a generally rectangular cavity extending downwardly therefrom and toward the lower panel of the front sectional. A continuous sheet of material is extended over the three interconnected sectionals and the common folds. The sheet of material has a pair of continuous side panels that are sized for covering the pair of side walls of the three interconnected sectionals. Lastly, a generally rectangular head supporting structure is sized for positioning within the cavity of the body supporting structure when not supporting a person's head.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon-which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved female anatomical mattress which has all of the advantages of the prior art female body supports and none of the disadvantages.

It is another object of the present invention to provide a new and improved female anatomical mattress which may be easily and efficiently manufactured and marketed.

It is further object of the present invention to provide a new and improved female anatomical mattress which is of durable and reliable constructions.

An even further object of the present invention is to provide a new and improved female anatomical mattress which is susceptible of a low cost of manufacture with regard to both materials and labor, and which accordingly is then susceptible of low prices of sale to the consuming public, thereby making such female anatomical mattress economically available to the buying public.

Even still another object of the present invention is to provide a female anatomical mattress for providing a mattress that will allow a woman to lie face down with the stomach resting against the mattress and the breasts resting within the cavity of the mattress.

Lastly, it is an object of the present invention to provide a new and improved female anatomical mattress including a generally rectangular body supporting structure. The body supporting structure has a pair of side walls with a continuous central section. The central section has an upper panel and a lower panel. The upper panel and lower panel each share a rounded front end and a rounded rear end. The upper panel has a generally rectangular cavity that extends downwardly therefrom and toward the lower panel. Lastly, generally rectangular head supporting structure is provided. The head supporting structure is sized for positioning within the cavity of the body supporting structure, when not supporting a person's head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
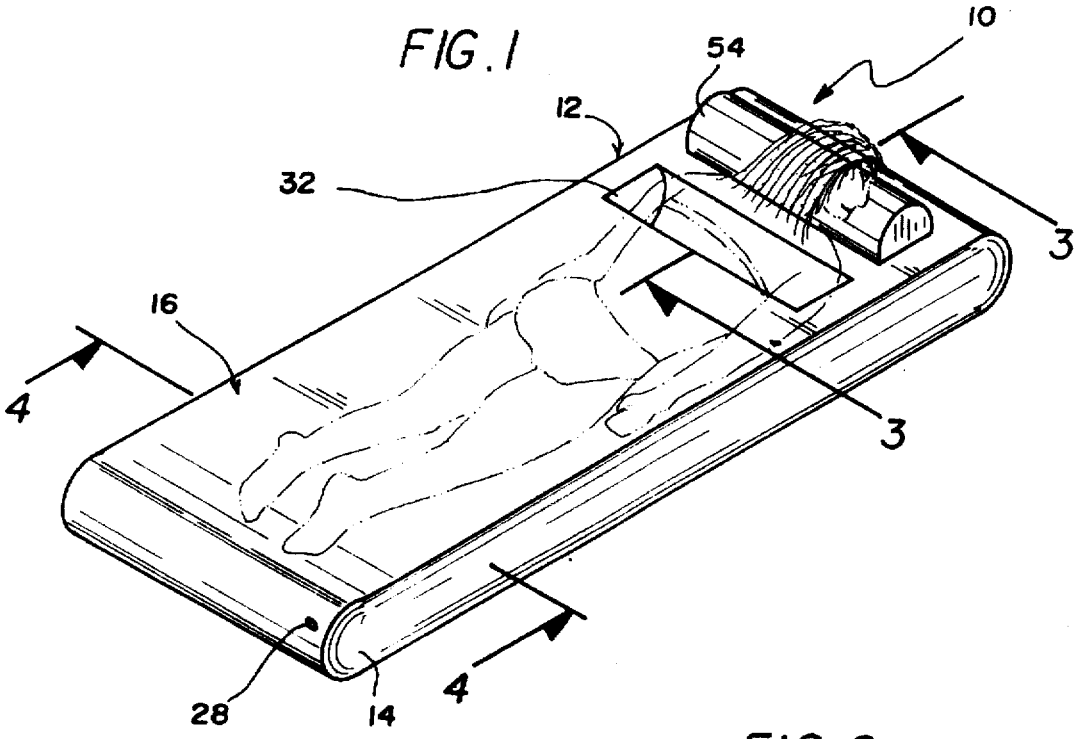
FIG. 1 is a perspective view of an embodiment of the female anatomical mattress constructed in accordance with the principles of the present invention.
Figure 3:
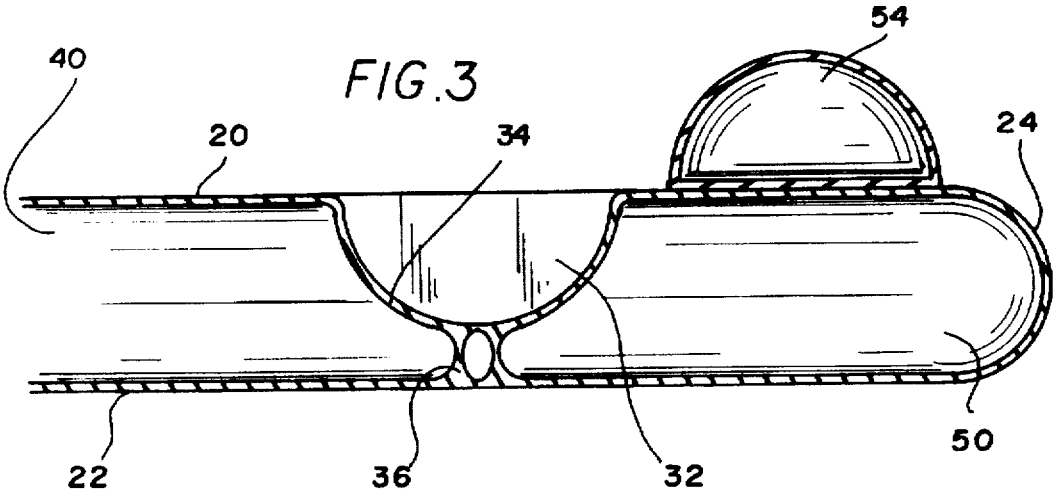
FIG. 3 is an isometric view of the preferred embodiment of the female anatomical mattress of the present invention.

With reference now to the drawings, and in particular to FIGS. 1 and 3 thereof, the preferred embodiment of the new and improved female anatomical mattress embodying the principles and concepts of the present invention and generally designated by the reference numerals 10 and 60 will be described.

The present invention, the female anatomical mattress is comprised of a plurality of components. Such components in their broadest context include a body supporting structure and head supporting structure. Such components are individually configured and correlated with respect to each other so as to attain the desired objective.

Figure 2:
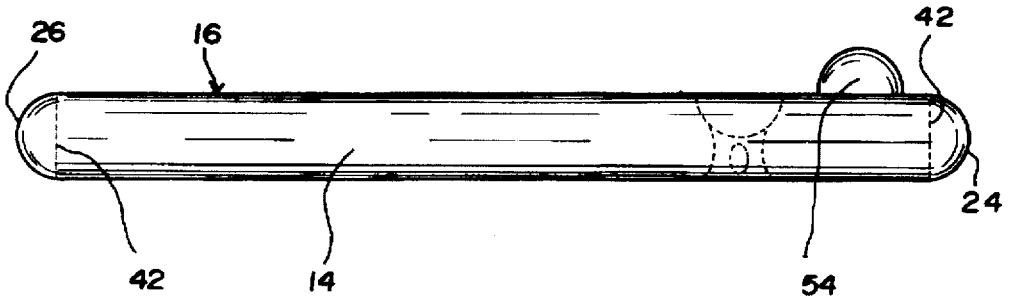
FIG. 2 is a side elevational view of the present invention as shown in FIG. 1.
Figure 5:
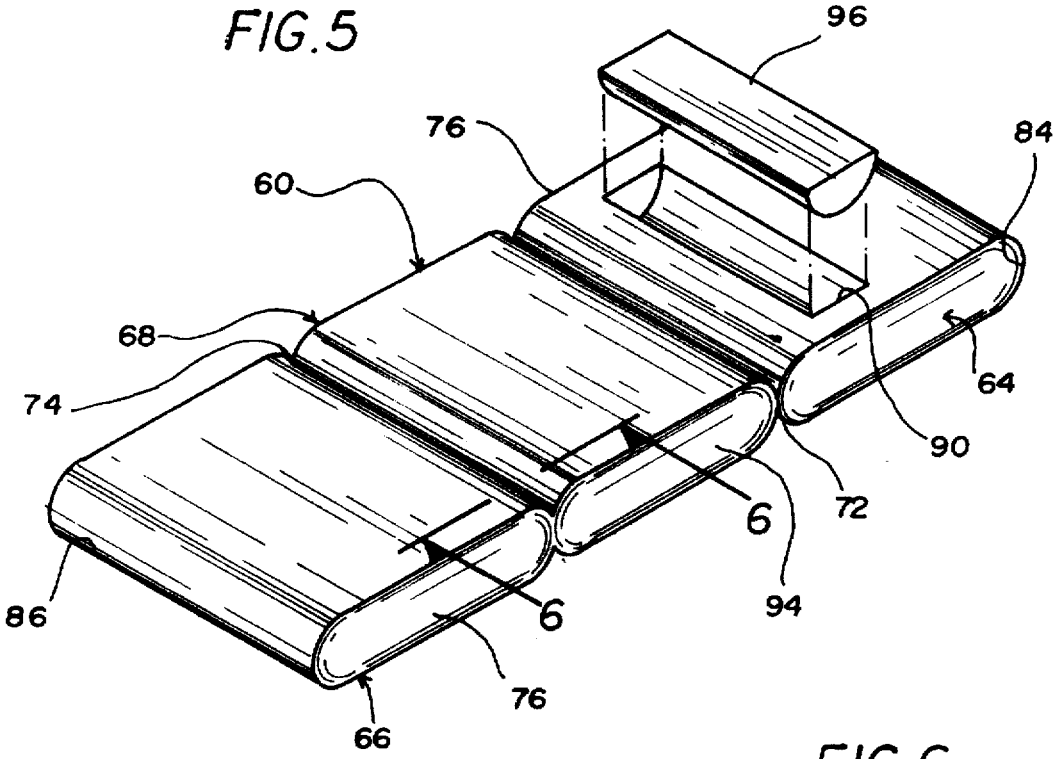
FIG. 5 is a cross sectional view of the present invention taken along line 5—5 of FIG. 1.

Specifically, the present invention includes a generally rectangular body supporting structure 12. The body supporting structure is either inflatable or a solid. As seen in FIG. 1, the body supporting structure has a pair of elongated side walls 14 with a continuous central section 16 and is inflatable. The inflatable body supporting structure of is formed of a plastic. FIG. 3, shows the preferred body supporting structure formed of a foam material. The central section of the inflatable body supporting structure has an upper panel 20 and a lower panel 22, as shown in FIG. 5. The upper panel and lower panel each share a rounded front end 24 and a rounded rear end 26. As seen in FIG. 2, the rounded front end interconnects the upper panel to the lower panel.

Also, as shown in FIG. 2, the rounded rear end interconnects the upper panel to the lower panel. The rounded rear end has a valve 28, that will allow air to enter the body supporting structure. The Upper panel has a generally rectangular cavity 32 that extends downwardly therefrom and toward the lower panel, as seen in FIG. 3. The cavity is lateral to the pair of elongated side walls and spaced from the rounded front end. The cavity has a cavity wall 34 with a lower point resting upon a pair of interior support columns 36. The support columns are each interconnected to the lower panel and prevent sliding of the cavity. The cavity is structured to receive the breasts of a female lying face down on the body supporting structure.

Figure 4:
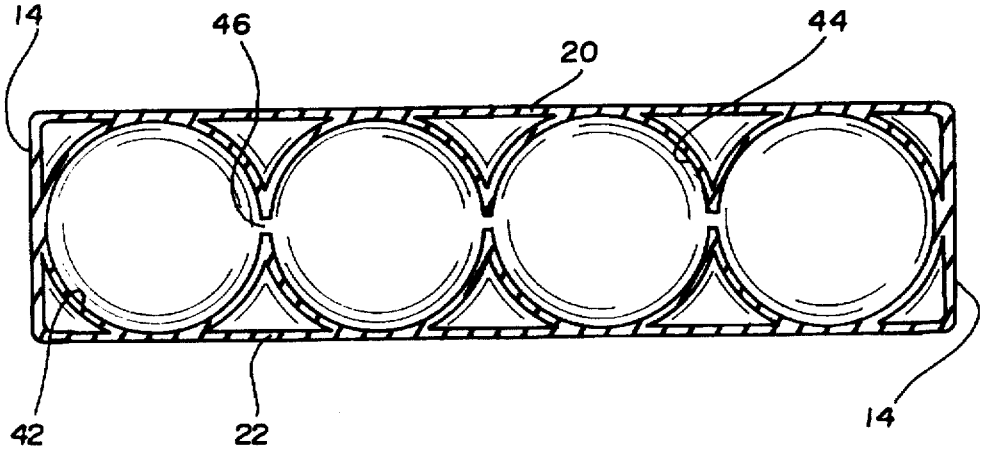
FIG. 4 is a cut-away-cross sectional view of the present invention taken along line 4—4 of FIG. 3.

The preferred female anatomical mattress has a generally rectangular body support structure 60 that is formed by three interconnected sectionals. As shown in FIG. 4, the three interconnected sectionals are formed of a foam material 62. The three interconnected sectionals form a front section 64, a rear section 66 and a central section 68 therebetween. The front section and the central section have one common fold 72. The rear section and the central section have another common fold 74. Each interconnected sectional has a pair of side walls 76 with the side walls of each being continuous at the respective common fold of the three interconnected sectionals, as shown in FIG. 3.

Additionally, each of the three interconnected sectionals has an upper panel 80 and a lower panel 82. The upper panel of the front sectional has a rounded front end 84 that is shared with the lower panel of the front sectional. The upper panel of the rear sectional has a rounded rear end 86 that is shared with the lower panel of the rear sectional. The upper panel of the front sectional has a generally rectangular cavity 90 that extends downwardly therefrom and toward the lower panel of the front sectional.

A continuous sheet of material 92 is provided. The sheet of material is extended over the three interconnected sectionals 64, 66, and 68, and the commons folds 72 and 74. The sheet of material has a pair of continuous side panels 94 that is sized for covering the pair of side walls of the three interconnected sectionals, as seen in FIG. 3. Finally, a generally rectangular head supporting structure 96 is sized for positioning within the cavity of the body supporting structure, when not supporting a person's head. The head supporting structure can be inflatable or formed of the same foam and covered by the material as the body supporting structure 60.

Figure 6:
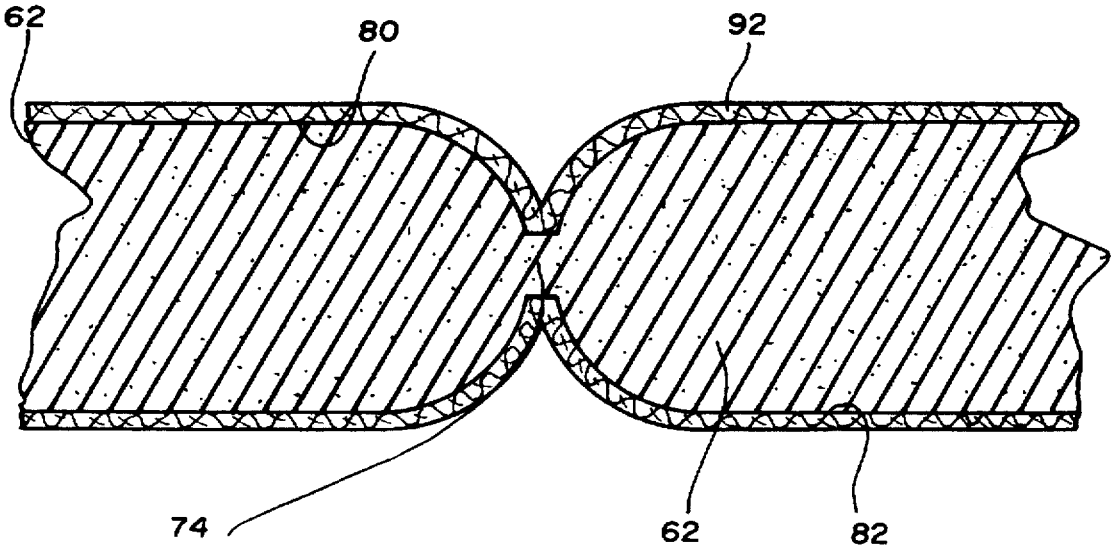
FIG. 6 is a cross sectional view of the present invention taken along line 6—6 of FIG. 1.

Lastly, as best illustrated in FIG. 5, the inflatable body supporting structure has a first air-tight chamber 40. The air-tight chamber is formed within the pair of the elongated side walls 14 and the continuous central section 16 of the body supporting structure. The air-tight chamber has a pair of outer air tubes 42 and a pair of inner air tubes 44 and has common air passages 46. The outer tubes and inner air tubes of the air-tight chamber receives air through the valve for inflation and deflation of the body supporting structure. The pair of outer air tubes have one each parallel and extending length-wise one of the pair of elongated side walls 14. The pair of outer air tubes have one each interconnected to one of the pair of elongated side walls, as shown in FIG. 6. The pair of inner air tubes each is interconnected to each other and one of the outer air tubes. The pair of air tubes extends from the rounded rear end to the cavity of the upper panel.

Furthermore, a second air-tight chamber 50 is formed between the rounded front end 24 of the central section and the cavity 32 of the upper panel, as seen in FIG. 5. The second air-tight chamber has a back wall that is common with the cavity wall 34 of the cavity of the upper panel. The second air-tight chamber has a front wall-that is common with the rounded front end of the central section. The second air-tight chamber shares a common air passage with the pair of elongated outer tubes. The second air-tight chamber inflates and deflates with the inflation and deflation of the first air-tight chamber.

Finally, a generally rectangular head supporting structure 54 is provided. The head supporting structure is sized for positioning within the cavity 32 of the body supporting structure 12. The head supporting structure is position in the cavity when it is not supporting a person's head. The head supporting structure is inflatable and has a separate valve. The head supporting structure may have a connecting flap that is interconnected with the cavity wall. The flap would allow the head supporting structure to remain attached to the body supporting structure at all times.

The present invention female anatomical mattress is a full length cushion that is designed to allow women to lie on their stomachs comfortably. The invention features a cavity that can be known as a chest cavity which is made to accommodate large or sensitive breasts. The primary function is to avoid/reduce breast compression while lying face down, as a result the spinal cord will not be strained. The mattress of the present invention, because of the added chest cavity, relieves back strain that is normally associated when a female lies face down. Included with the present invention is a head rest or pillow. The head rest is structure to fit within the cavity of the body supporting structure. The present invention can be offered in an inflatable style or a foam style. The foam style is preferred form of the present invention because it offers the maximum amount of flexibly with use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A female anatomical mattress for supporting a woman laying face-down comprising in combination:

a generally rectangular body supporting structure being formed by three interconnected sectionals, the three interconnected sectionals being formed of a foam material, the three interconnected sectionals forming a front section, rear section and a central section therebetween, the front section and the central section having one common fold with the rear section and the central section having another common fold, each interconnected sectional having a pair of side walls with the side walls of each being continuous at the respective common fold of the three interconnected sectionals, each of the three interconnected sectionals having an upper panel and a lower panel, the upper panel of the front sectional having a rounded front end being shared with the lower panel of the front sectional, the upper panel of the rear sectional having a rounded rear end being shared with the lower panel of the rear sectional, the upper panel of the front sectional having a generally rectangular cavity extending downwardly therefrom and toward the lower panel of the front sectional;

a continuous sheet of material extending over the three interconnected sectionals and the common folds therebetween, the sheet of material having a pair of, continuous side panels being sized for covering the pair of side walls of the three interconnected sectionals; and a generally rectangular head supporting structure being sized for positioning within the cavity of the body supporting structure when not supporting a person's head.

2. A new and improved female anatomical mattress for supporting a woman laying face-down comprising in combination:

a generally rectangular body supporting structure having a pair of elongated side walls with a continuous central section, the body supporting structure being inflatable, the central section having an upper panel and a lower panel, the upper panel and lower panel each sharing a rounded front end and a rounded rear end, the rounded front end interconnecting the upper panel to the lower panel, the rounded rear end interconnecting the upper panel to the lower panel, the rounded rear end having a valve, the upper panel having a generally rectangular cavity extending downwardly therefrom and toward the lower panel, the cavity being lateral to the pair of elongated side walls and spaced from the rounded front end, the cavity having a wall with a lower point resting upon a pair of interior support columns connected to the lower panel to prevent sliding of the cavity;

a first air tight chamber being formed within the pair of elongated side walls and the continuous central section of the body supporting structure, the air tight chamber having a pair of outer air tubes and a pair of inner air tubes each having common air passages, the pair of outer air tubes being parallel and extending lengthwise of the pair of elongated side walls, the pair of outer air tubes being interconnected to one of the pair of elongated side walls, the pair of inner air tubes each being interconnected to each other and one of the outer air tubes, the pair of inner air tubes extending from the rounded rear end to the cavity of the upper panel;

a second air tight chamber being formed between the rounded front end of the central section and the cavity of the upper panel, the second air tight chamber having a back wall being common with the cavity of the upper panel and a front wall being common with the rounded front end of the central section, the second air tight chamber-sharing a common air passage with the pair of elongated outer air tubes; and a generally rectangular head supporting structure being sized for positioning within the cavity of the body supporting structure when not supporting a person's head, the head supporting structure being inflatable.

* * * * *